US005813951A

United States Patent [19]

Einsig

[11] Patent Number: 5,813,951

[45] Date of Patent: Sep. 29, 1998

[54] TOTAL BODY EXERCISING AND REHABILITATION WEIGHT LIFTING MACHINE AND METHOD

[76] Inventor: Harold Joseph Einsig, 3447 Aubrey Ave., Philadelphia, Pa. 19114

[21] Appl. No.: 857,969

[22] Filed: May 16, 1997

Related U.S. Application Data

[63] Continuation of Ser. No. 550,199, Oct. 30, 1995, abandoned.

[51] Int. Cl.[6] ..... A63B 21/06

[52] U.S. Cl. ..... 482/97; 482/6; 482/24; 482/110

[58] Field of Search ..... 482/94, 97, 1, 482/100, 101, 104, 110, 112, 113, 128, 129, 148, 135, 136, 137

[56] References Cited

U.S. PATENT DOCUMENTS 4,406,452 9/1983 Lapcevic ..... 482/97
4,629,185 12/1986 Amann ..... 482/113

OTHER PUBLICATIONS

"Motor Driven Barbell Vibrates the Muscles." *Popular Mechanics* (Feb. 1986) p. 136.

*Primary Examiner*—Richard J. Apley
*Assistant Examiner*—John Mulcahy

[57] ABSTRACT

A single-station type total body exercise and rehabilitation weight-lifting machine and method of selectively recruiting, isolating, and maximally contracting a specific segment of a target muscle or task-specific synergistic segments of different muscles using the machine are presented. The exercise and rehabilitation machine is designed to provide resistance to variable force vectors in all directions. The machine comprises a weight support member mounted in a box-shaped main support frame. The rear end of the weight support member is multi-pivotally connected through a "sliding box" adjustment device to the rear of the main support frame while the front end of the weight support member is supported by a vertically adjustable roller bar support member of the main support frame. The weight support member can be oriented at many angles using the combined adjustments for the sliding box adjustment device and roller bar support member. The force required to move the weight support member may be infinitely varied by adding or removing weight plate members. The user is not limited to working against a single directional force but may create a resistance force in any direction and perform multiple exercises using only one machine. Since different muscle segments create different force vectors, the user can selectively train a particular muscle segment or synergistic segments of different muscles by selecting the force vector on the machine against which the user must work.

14 Claims, 6 Drawing Sheets

TOTAL BODY EXERCISING AND REHABILITATION WEIGHT LIFTING MACHINE AND METHOD

This application is a continuation of application Ser. No. 08/550,199, filed Oct. 30, 1995, now abandoned.

The present invention relates to a total body exercise and rehabilitation weight-lifting machine and method of selectively recruiting, isolating, and maximally contracting a specific segment of a target muscle or task-specific synergistic segments of different muscles using the machine.

Many types of weight-lifting exercise devices are well known and currently in a widespread use but most currently available devices do not allow the natural movements of free weight lifting exercise routines. Most exercise machines provide for fixed linear or planar exercise motions, and those machines having cams impart a fixed strength/resistance curve that is not applicable to all users. Differences in limb length, overall height, and strength create poor interuser utility on most machines. Many machines require the user to align the axis of rotation of the joint being utilized with the axis of rotation of the machine, and such alignment may be impossible to attain by users having very long or short limbs. Exercise machines using tension bands provide linear increases in resistance at the end of the exercise range of motion, which may totally oppose the resistance pattern desired by the user. To train with the desired specificity of resistance would typically require the user to employ many different exercise machines, and even then, changing the point in the range of motion at which most resistance is encountered is extremely difficult, if not impossible, to do on currently available exercise machines.

There is a range of movement with free weight lifting which is very desirable as it allows the user to create an exercise routine tailored to his or her particular abilities and needs. It is generally agreed that free weight exercises are the most essential type for specificity, strength, and hypertrophy training. However, free weight exercises have significant limitations on their use for weight training. Perhaps the foremost limitation is that the only resistance vector encountered with free weights is straight down, i.e., in the direction of gravity. Also, the freedom of range of movement attainable with free weights is accompanied by an increased risk of injury since safety stops in the range of motion are typically not available. Consequently, a spotter may be required to reduce and/or avoid the increased risk of injury. There is a need for a weight-lifting exercise and rehabilitation machine which offers the advantages of free weight lifting but reduces the aforementioned increased risk of injury while providing practical advantages over free weight training by enabling the user to selectively change the force vector opposed in multiple directions in addition to that of gravity.

The described invention allows free weight training motions plus selective force vector of resistance variations, requires no spotter, has built in safety stops, and can be equally effectively used by exercisers of all heights and limb lengths.

The inventor has found that vibration of the apparatus used in this invention enhances the effectiveness of the apparatus. This has some support by recent studies that indicates vibrations stimulate muscle spindles to facilitate contraction. Zhu, Y. and Starr, A., "Magnetic Stimulation of Muscle Evokes Cerebral Potentials," *Muscle & Nerve* 14: 721–732 (1991). The exercise and rehabilitation weight-lifting machine and method of the present invention provides an optional vibrational component of force for the user to counteract and thereby effect muscle contraction.

Most important, the present invention permits exercise of chosen muscle subsets. This advantage is better understood with reference to recent studies dealing with the control of muscular movement by the central nervous system (CNS) which suggest that CNS elements control the movement of subsets of muscles rather than whole muscles and that the regulation of movement depends upon the control of excitability of motor neuron aggregates based on neuromuscular compartment nuclei rather than on entire muscle motor nuclei. These findings are consonant with the partitioning hypothesis which states that individual muscles are organized into neuromuscular compartments which are paralleled by the organization of their parent motor neurons within the spinal cord. Thus, neuromuscular compartments may have functional or task-oriented roles., i.e., different portions of one muscle may be called into play depending on the task demands of the particular situation. These findings may be therapeutically significant in the field of rehabilitative medicine, particularly in clinical applications such as neuromuscular stimulation or kinesiological monitoring. English, A. W., Wolf, S. L., and Segal, R. L., "Compartmentalization of Muscles and Their Motor Nuclei: The Partitioning Hypothesis," *Physical Therapy* 73:12 (Decemeber 1993). Consequently, physical therapists and doctors in rehabilitative medicine are enabled by the present invention to begin to focus on working with specific segments of target muscles and/or synergistic segments of different muscles rather than whole muscles.

In addition, there are many potential benefits of exercising a specific segment of a muscle or synergistic segments of different muscles used to perform a motion using the present invention including 1) providing a means to exercise any muscle even though injury or range-of-motion deficit exists at some point in the musculoskeletal complex; 2) allowing specific rehabilitation prescription for post musculoskeletal injury; 3) overcoming weaknesses at any given point in the range-of-motion; 4) potentially speeding up rehabilitation time due to elimination of the conventional 48–72 hour period of rest between total muscle exercise sessions by exercising only specific segments at different times during the period; 5) enabling enhanced muscle symmetry and balance; and 6) efficiently developing new muscular definition.

Accordingly, the present invention provides a total body exercise and rehabilitation weight-lifting machine which allows the user to perform substantially all of the natural movements of free weight lifting exercise routines.

Therefore, the present invention provides a total body exercise and rehabilitation weight-lifting machine and method which allow the user to selectively recruit, isolate, and maximally contract a specific segment of a muscle or synergistic segments of different muscles as the user desires.

Gross anatomy, biomechanic and kinesiologic analyses, subjective muscle segment exercise induced fatigue, and objective quantitative surface electrode electromyography/biofeedback data have been utilized to delineate the exercise machine and user positions as well as exercise motions to maximize intramuscular segmental specificity.

Furthermore, the present invention provides a total body exercise and rehabilitation weight-lifting machine which allows the user to vary the portion of the range of motion, i.e., selectively change the resistance curve for a given exercise motion, in which the user encounters the most resistance during different sets of the same exercise.

Still further, the present invention provides a total body exercise and rehabilitation weight-lifting machine which is easy to use.

Also, the present invention provides a total body exercise and rehabilitation weight-lifting machine which is safe to use by providing range of motion limits to prevent injury and to define exercise movement ranges for safe rehabilitation of previously injured tissue.

And further, the present invention provides, optionally, total body exercise and rehabilitation weight-lifting machine and method which has a vibrational component of force for the user to counteract and thereby effect muscle contraction.

The present invention also provides a rehabilitation method for selectively recruiting, isolating, and maximally contracting a known prime mover for a given motion without performing the actual motion, thus enabling the user to avoid a painful arc or connective tissue limitation while exercising the muscle to prevent atrophy.

The invention is a total body exercise and rehabilitation weight-lifting machine and method which enable the user to selectively recruit, isolate, and maximally contract a specific segment of a target muscle or task-specific synergistic segments of different muscles using the device and by staggering the times different segments of the same muscle group are exercised, permits different segments to be exercised during the same 24 to 48 hour period and speed up the exercise of the muscle group.

The above and numerous other objects of the invention that may be achieved by the method and preferred embodiment of the invention will be more readily understood from the following detailed description and the appended drawings wherein:

FIG. 1 is a perspective view of one embodiment of the weight support member of the total body exercise and rehabilitation weight-lifting machine.

FIG. 1*a* is an enlarged detail of a portion of FIG. 1.

DESCRIPTION OF THE PREFERRED EMBODIMENT

Figures 1, 1A:
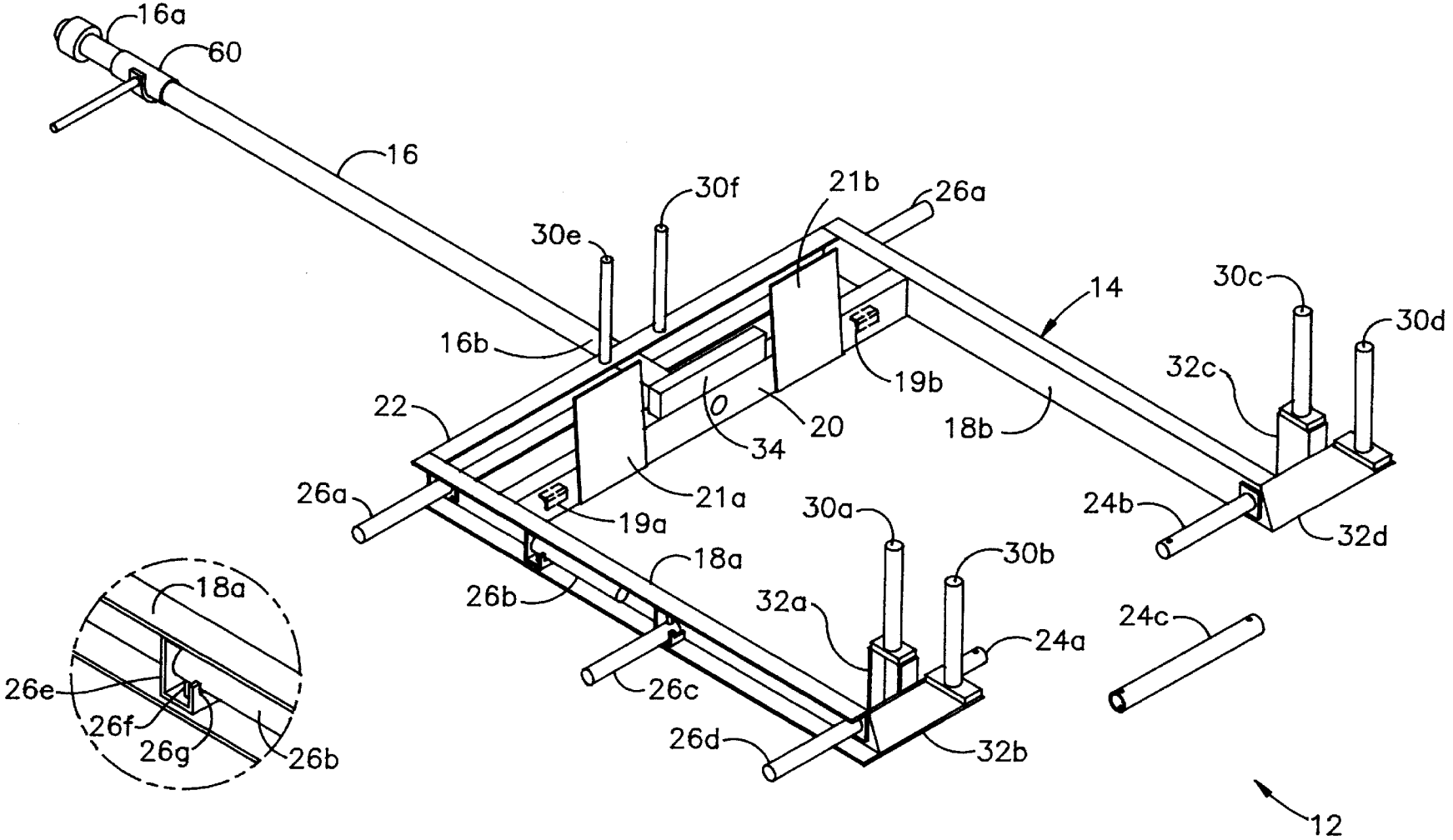

The first portion of the following detailed description concerns the total body exercise and rehabilitation weight-lifting machine of the present invention. The final portion of the description concerns the exercise and rehabilitation method of the present invention Total Body Exercise and Rehabilitation Weight-Lifting Machine Reference is now made to the drawings in detail, wherein like reference characters indicate like parts throughout the several figures. FIG. 1 is a perspective view of one embodiment of the weight support member 12 of the total body exercise and rehabilitation weight-lifting machine (not shown). The weight support member 12 comprises a weight support frame 14 at an anterior end and a support axis bar 16 at an elongated posterior end. The weight support frame 14 comprises two parallel runners 18*a* and 18*b* which have front ends and rear ends connected at one end (rear end) by front cross bar 20 and back cross bar 22. The runners 18*a* and 18*b* and cross bars 20 and 22 are preferably made of a light weight but strong metal such as an aluminum alloy. Foot plates 21*a* and 21*b*, which are inclined approximately 30 degrees toward the rear of the exercise and rehabilitation machine, are attached to front cross bar 20 and preferably made of a light weight but strong metal such as an aluminum alloy. User force applicators include handles 24*a* and 24*b* which extend inward partially across the other end of the weight support frame 14. A third handle component or handle bar 24*c* fits over handles 24*a* and 24*b*, extends completely across the other end of the weight support frame 14, and locks in place with a pull pin (not shown). The handle bar 24*c* allows the user to perform close grip exercises or exercises which require a handle to be positioned across the user's back, e.g., squats, toe raises, etc. Handle bar 24*c* is a thin hollow tube preferably made of a metal such as steel. The handles 24*a*, 24*b* and 24*c* are all fitted with hard plastic tube sleeves (not shown) to allow rotation around the handles without skin friction.

Runners 18*a* and 18*b* each have two fixed lock bars 26*a* and 26*d*, and two swing-out or moveable lock bars 26*b* and 26*c* (lock bars 26*b*, 26*c* and 26*d* are not seen on parallel runner 18*b* since they are either in the folded position or obscured behind other components) located on their outer sides which limit the forward and backward movement of the weight support member 12 during exercise or while the user changes the vertical position of the sliding box adjustment device on the main support frame (not shown). Lock bars 26*a*, 26*b* and 26*c*, and their counterparts on runner 18*b* are preferably made of a metal such as an aluminum alloy. Lock bar 26*d* and its counterpart on runner 18*b* (not shown) are preferably made of a metal such as steel since these two lock bars will support much of the weight of the weight support member 12 when positioned or "racked" on the upwardly extending hook members (not shown). Cross bar 20, which is slightly raised above the bottom surfaces of runners 18*a* and 18*b*, has two spring-loaded hinges 19*a* and 19*b* attached to its undersurface which act as stops when in the actuated position and serve to limit the forward and backward movement of the weight support member 12 on the roller bar support member (not shown) while the user changes the vertical position of the "sliding box" adjustment device (not shown) on the vertical adjustment post (not shown). The force components include downward force components and include weights carried by front weight support posts 30*a*, 30*b*, 30*c*, and 30*d* and their bases 32*a*, 32*b*, 32*c*, and 32*d*, extend upwardly from runners 18*a* and 18*b* and serve as attachment sites for detachable weight plate members (not shown). Likewise, rear weight support posts 30*e* and 30*f* extend upwardly from back cross bar 22 and serve as attachment sites for detachable weight plate members (not shown). The bases 32*b* and 32*d* are mounted forward of handles 24*a* and 24*b* such that the weight of weight support frame 14 posterior to handles 24*a* and 24*b* can be counterbalanced by weight plate members (not shown) positioned upon weight support posts 30*a* and b and 30*c* and d.

The support axis bar 16 is pivotally attached at a first end 16*a* to the main support frame with a "sliding box" adjustment device (not shown). A second end 16*b* of the support axis bar 16 is attached to the front cross bar 20 and the back cross bar 22 of the weight support frame 14. In this embodiment of the weight support member 12, the support axis bar 16 is a solid rod, preferably made of a metal such as steel.

An important option is a vibrating device 34, preferably generating vibrations in the approximately 40 to 80 Hz range, and more specifically at approximately 60 Hz. The vibration device is attached to the upper surface of the front cross bar 20 above the junction with the support axis bar 16. The vibrating device 34 may be used to impart vibrational motion to the user through the handles 24*a* and 24*b* or handle bar 24*c* as one additional mode of muscle stimulus possible with the exercise and rehabilitation machine. As an alternative, the machine may be designed to vibrate inherently. This is the case with the machine shown in FIGS. 1 and 3. The vibrations are specially usable towards the end of the exercises. The vibrator may be any readily available vibrator suitable for providing vibration to the structure of the desired frequency including vibrators of the type usable to vibrate beds.

FIG. 1*a* shows the details of the swing-out lock bar 26*b*. The bar 26*b* pivots about pivot 26*f* in housing 26*e*. It is free to ride up over notch 26*g* which holds it in a nested position when not swung out for use.

Figure 2:
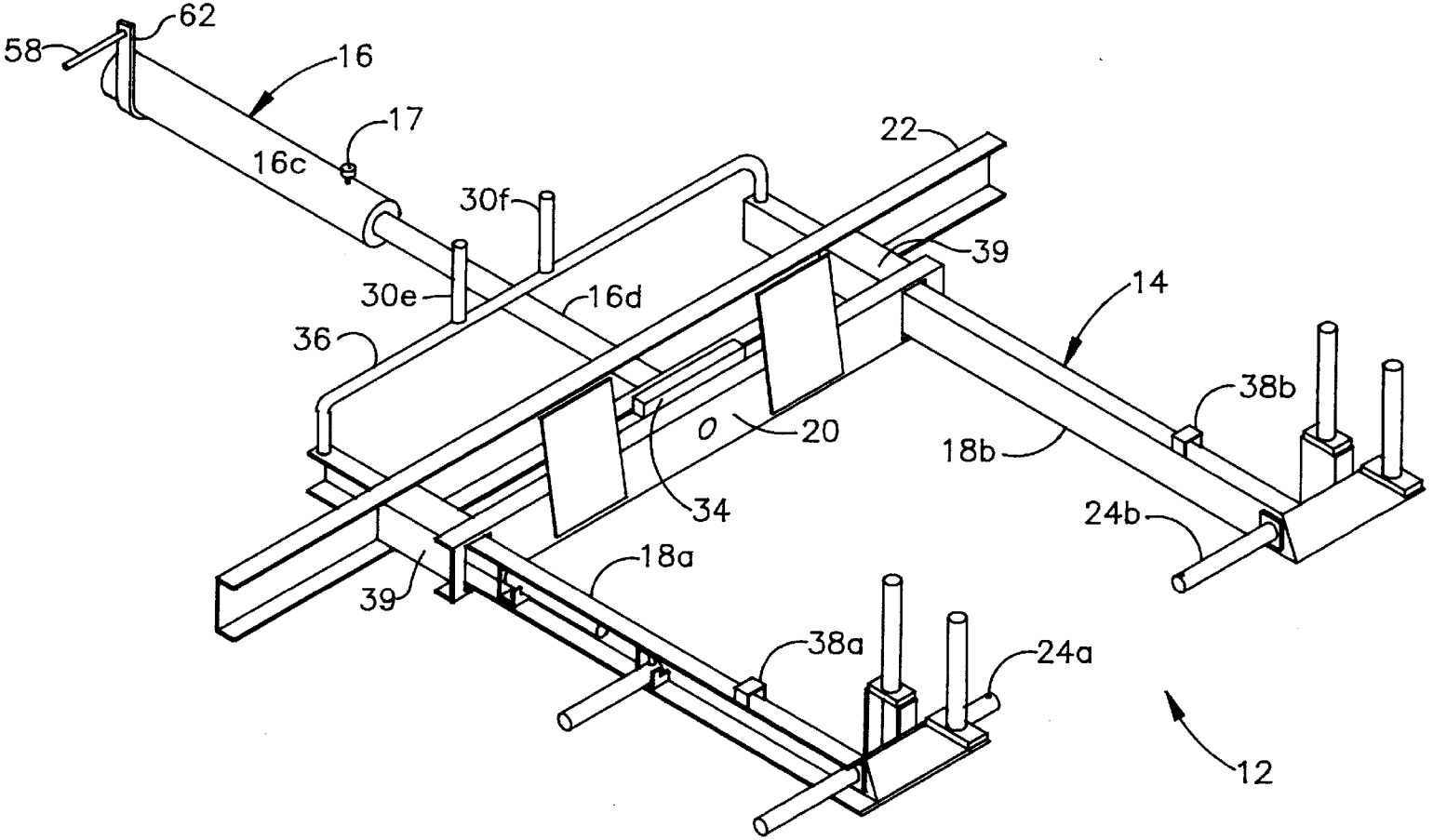
FIG. 2 is a perspective view of an alternative embodiment of the weight support member or "sled" of the total body exercise and rehabilitation weight-lifting machine which provides for an additional type of exercise, i.e., isokinetic, available with the machine.

FIG. 2 is a perspective view of an alternative embodiment of the weight support member 12 of the exercise and rehabilitation machine which requires no floor space behind the main support frame of the exercise machine (not shown) and adds the capacity for isokinetic motion. In this embodiment, the support axis bar 16 comprises a telescoping hydraulic cylinder 16*c* and piston rod 16*d* having a resistance adjuster 17 (available from HydraGym Athletics, Sugarland, Tex.). The runners 18*a* and 18*b*, which are connected by the cross bridge 36, slide through openings in the front cross bar 20 and the back cross bar 22 which are connected by rectangular tabular tunnels 39. Two channel roof extensions 38*a* and 38*b* located on the upper sides of the runners 18*a* and 18*b* limit the backward movement of the weight support frame 14 so that the handles 24*a*, 24*b* and/or handle bar 24*c* and the user's hands do not contact the front cross bar 20. The cross bridge arrests the forward movement and has weight support post 30*e* and 30*f* attached thereto.

Figure 3:
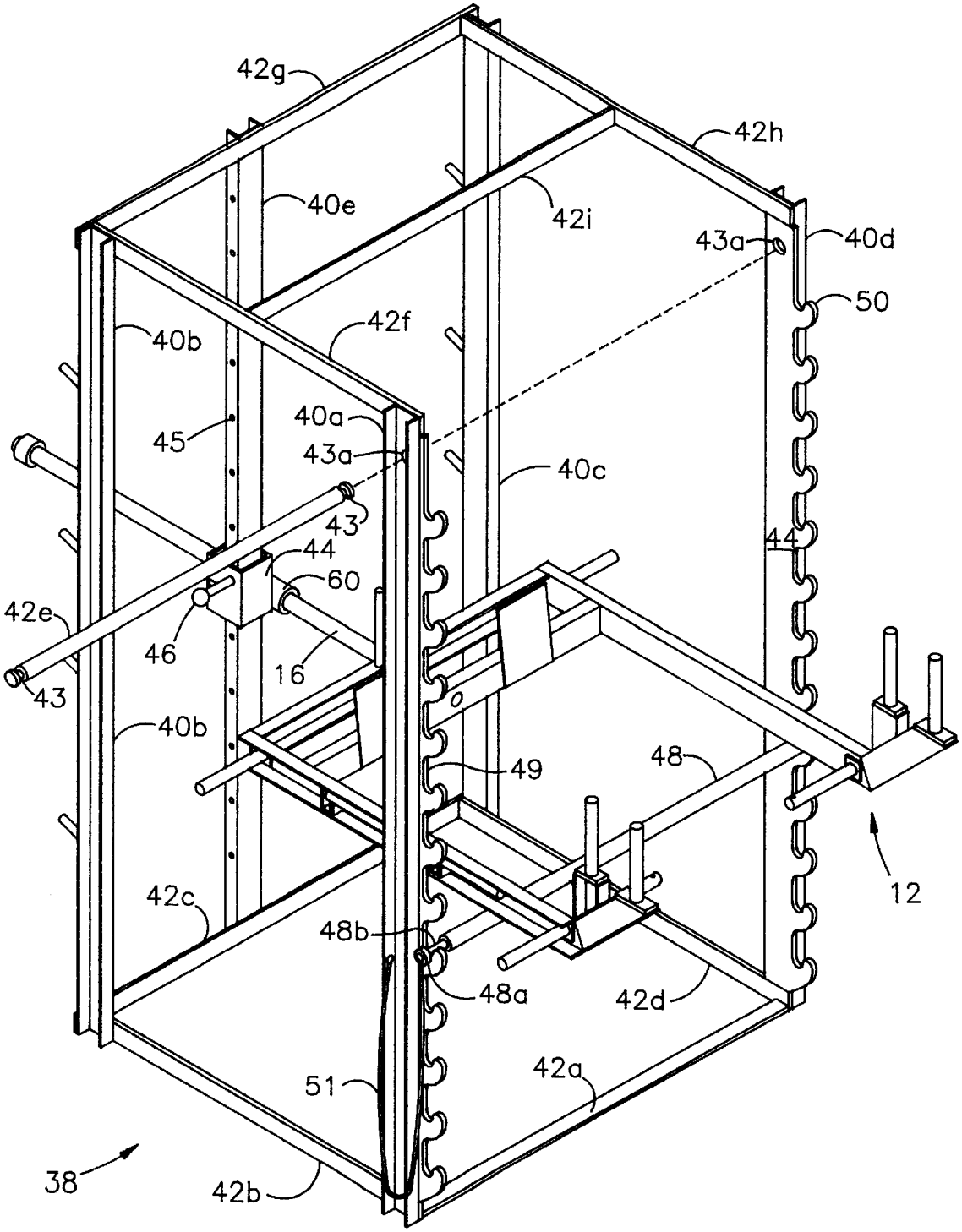
FIG. 3 is a perspective view of the weight support member mounted within the main support frame of the total body exercise and rehabilitation weight-lifting machine.

FIG. 3 is a perspective view of the weight support member 12 mounted within the main support frame or "cage" 38 of the exercise and rehabilitation machine. The main support frame 38 includes a plurality of upright or vertical support members 40*a*, 40*b*, 40*c*, and 40*d* interconnected with a plurality of cross-members 42*a*, 42*b*, 42*c*, 42*d*, 42*e*, 42*f*, 42*g*, and 42*h*, which are preferably made of a light weight but strong metal such as an aluminum alloy. Cross-member 42*e* is a removable chin up bar with shallow grooves 43 on both ends where it rests in holes 43*a* in upright support members 40*a* and 40*d*. Cross-member 42*i*, also preferably made of a light weight but strong metal such as an aluminum alloy, provides additional support in the middle of the main support frame 38.

The weight support member 12 is pivotally supported at a first end by a "sliding box" adjustment device 44 vertically adjustable pivot device mounted on a vertical adjustment post 40*e* or posterior upright or vertical support member of the main support frame 38. The vertical adjustment post 40*e* has a plurality of equidistant holes 45 drilled therein through, through which a pull pin 46 secures the sliding box adjustment device 44 in the desired vertical position. The weight support member 12 is supported at a second end by a rolling bar support member 48 over which it can roll. Roller bar or front support member 48, in conjunction with an axis tube 60 pivotally attached to sliding box adjustment device 44 through which support axis bar 16 may slide, allows anterior and posterior motion of weight support member 12. The upright support members 40*a* and 40*d* each have affixed thereto vertical adjustment plates 49 having a series of equidistant upwardly extending hook members 50 upon which the ends 48*b* of roller bar support member 48 rests. A permanent thin collar 48*a* on each end of roller bar support member 48 (one of two is shown) prevents lateral sliding and a tether cable 51 secures roller bar support member 48 to main support frame 38. Roller bar support member has an internal support rod about which an outside tubular sleeve rotates via a ball bearing interface. The weight support frame 12 may be mounted within main support frame 38 in various positions based on the vertical positions of the sliding box adjustment device 44 and the roller bar support member 48. The hook members 50 and holes 45 preferably number 13 each and are spaced apart vertically six inches. The weight support solid frame 14 is approximately 44 inches wide and 42 inches long. The axis bar 16 is approximately 68 inches long. When the hydraulic cylinder 16*c* is used rather than a solid rod or tube, the cylinder portion is approximately 28 inches long.

Figure 4:
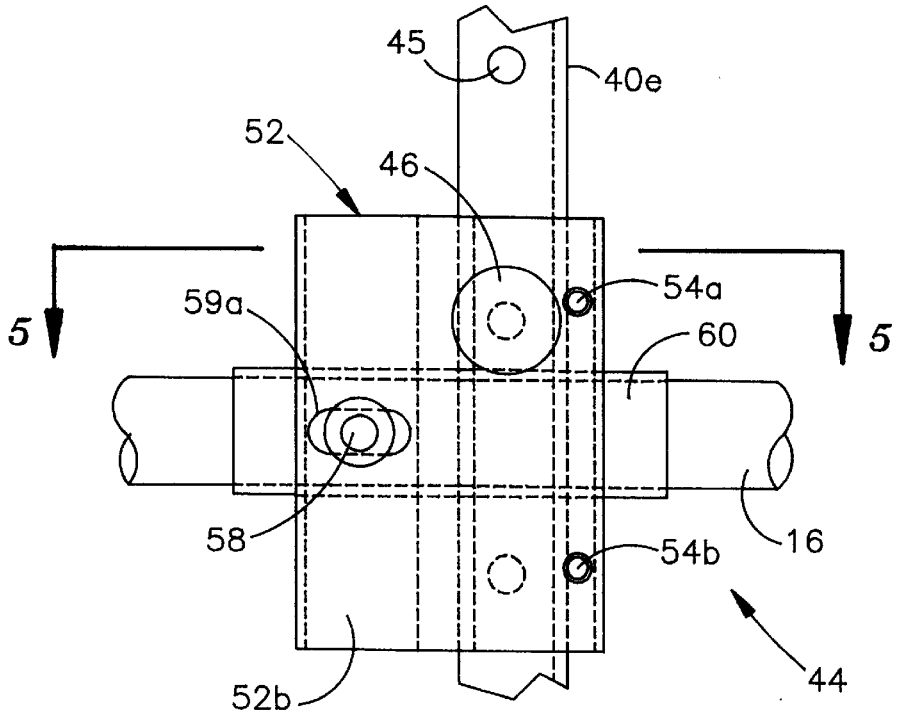
FIG. 4 is a side view of the "sliding box" adjustment device of the total body exercise and rehabilitation weight-lifting machine.

FIG. 4 is a side view of the "sliding box" adjustment device 44 and the axis tube 60, which shows the relative positions of the following: wall 52*b* (one of four is shown) of open box 52, rolling pins 54*a* and 54*b*, pull pin 46, pivot pin 58, oval opening 59*a* (one of two is shown), axis tube 60, support axis bar 16, vertical adjustment post 40*e*, and holes 45.

Figure 5:
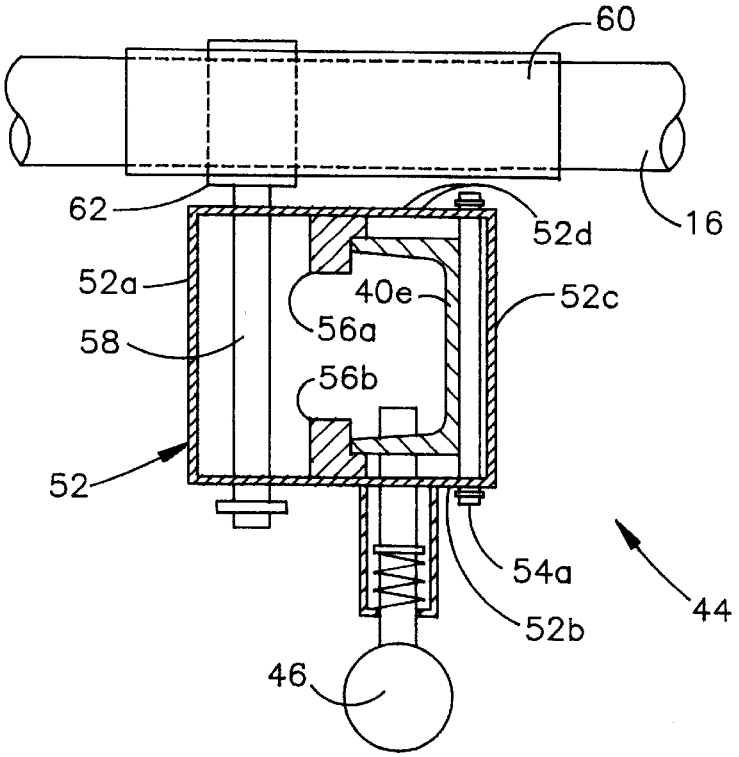
FIG. 5 is an overhead cross-section view of the "sliding box" adjustment device of the total body exercise and rehabilitation weight-lifting machine taken on Section 5—5 of FIG. 4.

FIG. 5 is an overhead view of the "sliding box" adjustment device 44. The sliding box adjustment device 44, which moves vertically along vertical adjustment post 40*e*, is used to adjust and secure the vertical slide and pivot position of the weight support member 12. The sliding box adjustment device 44 comprises an open box 52 having four walls 52*a*, 52*b*, 52*c*, and 52*d*, two rolling pins 54*a* and 54*b* extending through walls 52*b* and 52*d*, two slide bushings 56*a* and 56*b* attached to the interior of open box 52 which may be replaced by two additional rolling pins, a pull pin 46 extending through wall 52*b*, and an axis tube 60 pivotally attached by means of a pivot pin 58 to the open box 52.

The walls 52*a*, 52*b*, 52*c*, and 52*d* are made of a strong metal, such as tubular steel. The following pins 54*a* and 54*b*, preferably steel pins, enable the sliding box adjustment device 44 to roll (vertically) over the front surface of vertical adjustment post 40*e*. The bushings 56*a* and 56*b*, preferably made of a hard plastic, serve to reduce friction between the sliding box adjustment device 44 and vertical adjustment post 40*e* and also to keep the pull pin 46 properly aligned with holes 45 in vertical adjustment post 40*e*. The pull pin 46 serves as a handle for and also to lock the sliding box adjustment device 44 in the desired vertical position (through holes 45) on vertical adjustment post 40*e*.

The axis tube 60 is pivotally attached to the open box 52 by means of a pivot pin 58 extending through oval openings 59*a* (not shown) in walls 52*b* and 52*d*. The axis tube 60 is secured, preferably welded, to a U-shaped support member 62 which is attached, preferably welded, to one end of the pivot pin 58. The support axis bar 16 of the weight support member (not shown) may slide anteriorly and posteriorly through axis tube 60. This pivotal arrangement allows the user to move the weight support frame (not shown) horizontally, vertically, rectilinearly, and rotationally in essentially all directions in a manner similar to free weights.

Figure 6:
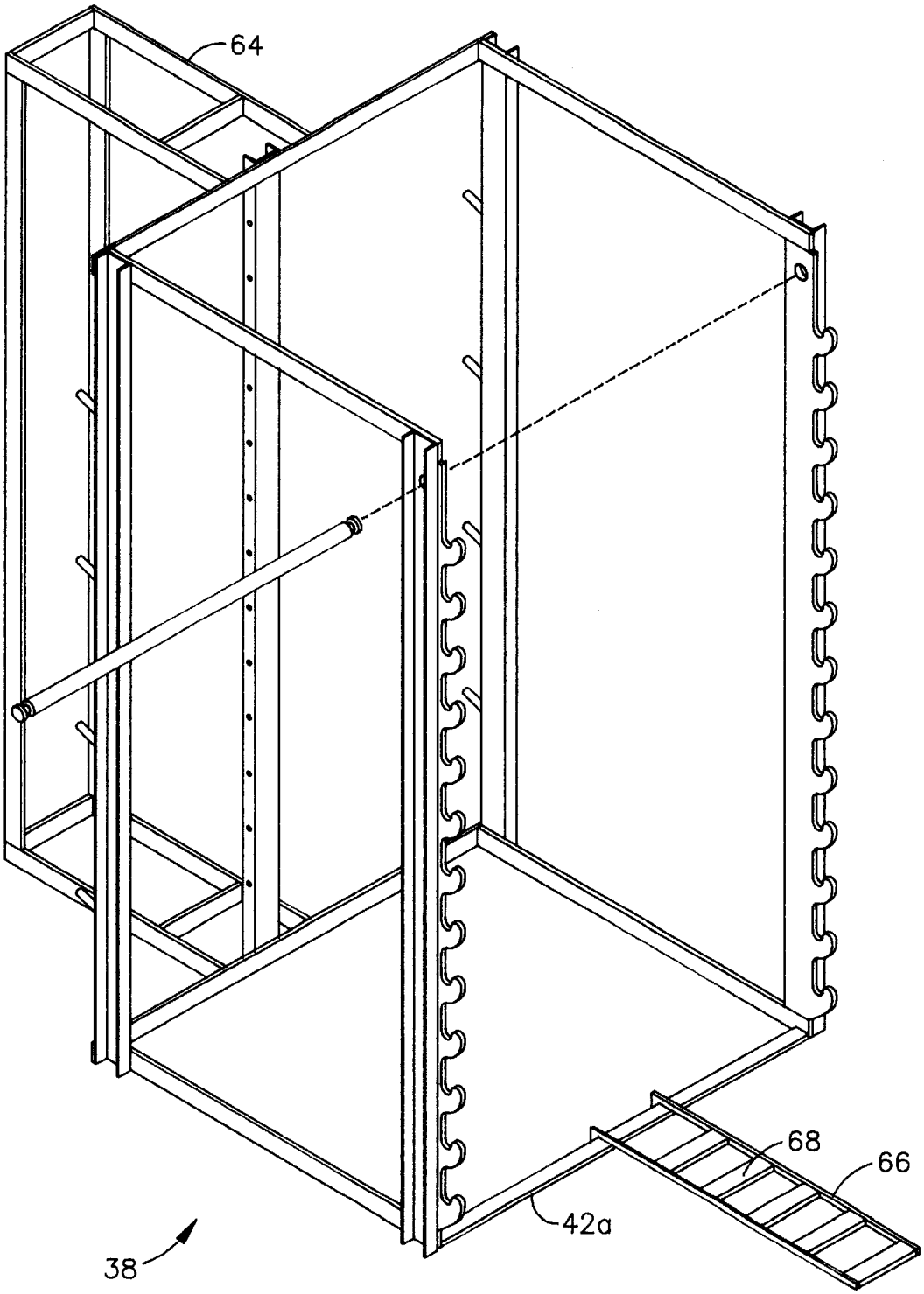
FIG. 6 is a perspective view of the main support frame of the total body exercise and rehabilitation weight-lifting machine.

FIG. 6 is a perspective view of the main support frame or "cage" 38 of the exercise and rehabilitation machine. An axis rod enclosure frame on supplemental cage 64 extends outwardly from the rear of the main support frame 38. A detachable bench-anchoring device 66 extends outwardly from the front of the main support frame 38 and is attached to the lower front cross-member 42*a*. When an incline bench (not shown) is placed on top of the bench-anchoring device 66, the slats 68 prevent forward or backward sliding of the bench while the user is exercising. In an alternative embodiment (not shown), a wider non-detachable bench-anchoring device extends outwardly from the front of the main support frame 38.

Figure 7:
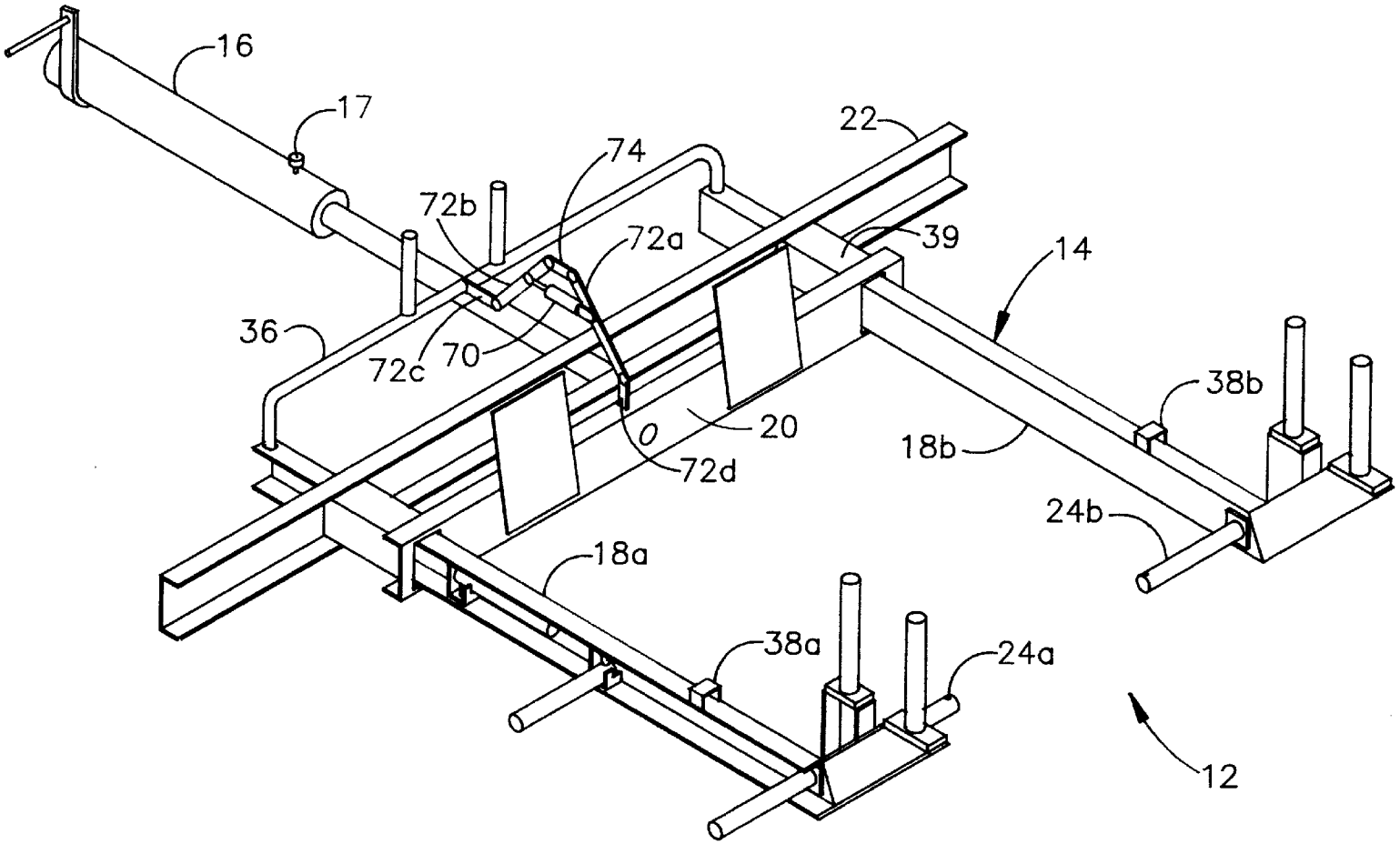
FIG. 7 is a perspective view of a third embodiment of the weight support member of the total body exercise and rehabilitation weight-lifting machine which provides for an additional type of exercise, i.e., isokinetic, available with the machine.

FIG. 7 is a perspective view of a third embodiment of the weight support member 12 of the exercise and rehabilitation machine which is similar to the embodiment of FIG. 2 and which requires no floor space behind the main support frame of the exercise machine (not shown) and has the capacity for isokinetic motion. In this embodiment, a second small hydraulic cylinder assembly includes a hydraulic cylinder 70 which is positioned as part of an inverted U-shaped arrangement between and above the front cross bar 20 and the cross bridge 36 of the weight support member 12. The inverted U-shaped arrangement allows pivot of the assembly comprising two bars 72*a* and 72*b* which extend upwardly from pivotal connections to the front cross bar 20 and the cross bridge 36, respectively, and are pivotally connected with a third bar 74 which forms the top of the inverted "U". The hydraulic cylinder 70 also links bars 72*a* and 72*b* with pivotal connections and is parallel to bar 74. Link for 72*b* is pivotally connected to horizontal post 72*c* which is welded to 36. Likewise, link for 72*a* is pivotally connected to vertical post 72*d* which is welded to 20. Alternatively, the one centrally located hydraulic cylinder 70 could be replaced by two similar cylinder arrangements located bilaterally out near runners 18*a* and b with the small bar connecting 36 to 72*b* on FIG. 7 oriented vertically instead of horizontally, thus not reducing anterior/posterior range of motion.

Method for Selectively Recruiting, Isolating, and Maximally Contracting a Specific Segment of a Muscle or Synergistic Segments of Different Muscles A method for selectively recruiting, isolating, and maximally contracting a specific segment of a muscle or synergistic segments of different muscles as the user desires is presented, which comprises the following steps:

(1) providing a total body exercise and rehabilitation weight-lifting machine similar to the present invention;

(2) locking the weight support member of the machine in the anterior position over the roller bar support member of the machine using the spring-loaded hinges attached to the undersurface of the front cross bar of the weight support member or similar lock that arrests forward/backward movement;

(3) looking up the suggested adjustment settings on a chart similar to the chart in the Appendix.

(4) adjusting the sliding box adjustment device of the machine to the desired vertical position;

(5) resting the weight support member on two upwardly extending hook members above the desired vertical position of the roller bar support member by placing the lock bars in the hook members;

(6) adjusting the roller bar support member to the desired vertical position by placing the ends in the selected hook members;

(7) positioning a plurality of weight plate members onto the weight support frame of the machine;

(8) positioning the body of the user as required by a particular exercise routine; and (9) moving the weight support member of the machine to the exercise position and proceed to exercise as required to maximally contract a specific segment of a muscle as the user desires.

A basic exercise position chart which provides the vertical positions for both the sliding box adjustment device and the roller bar support member, the positions of the user's body, and the movements of the weight support member for selectively recruiting, isolating, and maximally contracting a specific segment of a muscle or synergistic segments of different muscles appears in the Appendix to this application. The positions provided are for the average user and may be varied to suit the needs of the particular user. For example, a shorter user may use lower settings for the sliding box adjustment device and the roller bar support member whereas a taller user may use higher settings for each. The following examples will serve to illustrate the method of the present invention but are in no way intended to limit the scope of the invention which is defined in the appended claims.

The above method is practiced as above but utilized with an additional step of vibrating the part of the apparatus that moves so that the user receives vibrations that are preferably 40 to 80 per second and specifically approximately 60 per second to enhance the effectiveness of the exercise, especially when near muscle fatigue.

A third method is to utilize the first or second method in a manner to speed up the strengthening exercise of muscle groups. Normally, strengthening exercise of muscle group is conducted at forty-eight to seventy-two hour intervals. The present invention permits this to be expedited by exercising selected segments of the same muscle group for exercising at one time and then exercising other selected segments at a second time during the ensuing twenty-four hour period so that multiple strengthening exercises of the same muscle group occur at more frequent than normal intervals and the individual specific segments may be strength-trained at a more frequent interval than previously usual. The mechanisms and advantages are as follows:

(1) Intramuscular segmental exercise increases blood flow to surrounding muscle segments (motor recruitment patterns are more specific than hemodynamic pattern changes) enhancing catabolic waste product removal from previously exercised tissues, thus limiting exercise induced muscle soreness and increasing anabolic processes by improving nutrition to the area.

In addition, the efficient function of lymphatic and venous channels, which are conduits for catabolic product removal, is assisted if not dependent on local muscle contraction. Furthermore, local strengthening exercise stimulates releases of both local and systemic growth factors. The process of daily alternating intramuscular segmental exercise could then increase venous and lymphatic clearance of segmental catabolic products, improve the quantity of anabolic nutrient blood flow and provide more frequent release of growth factors to the previously exercised muscle. Therefore, the strength training "refractory period" and the total recovery period of exercised muscle are reduced, thus decreasing the minimum time period required to achieve a given hypertrophy/strength increase for a muscle or muscle group when compared to conventional methods.

(2) Clinically, a therapist or trainer who is asked to strengthen muscle following an isolated extremity injury can have the patient/athlete perform supervised strengthening exercise to the muscle group daily by alternating segments. This can increase patient contact sessions and promote their active role in rehabilitation/strengthening which may confer psychological gains to the patient/athlete as well when compared to the every other or every third day strengthening method.

For all the following strengthening/hypertrophy exercise examples, the motions should be done slowly through the full range of motion to maximize recruitment by reducing momentum and to limit injuries related to high velocity movements.

For all the following exercise motion descriptions only the concentric phase is described. The weight support member is then slowly returned to the starting position, resisting the same forces during the eccentric phase as in the concentric phase of the motions.

EXAMPLE 1

[Involving a Muscle Partitioned in the Horizontal (Transverse) Plane]

The following steps allow the user to selectively exercise the anterior, posterior, and lateral portions of the deltoid muscle, respectively.

Anterior Portion of the Deltoid Muscle

The average user locks the sliding box adjustment device in vertical position number 12 on the vertical adjustment post and places the roller bar support member on two upwardly extending hook members in vertical position number 8. These positions may be varied to suit the needs of the particular user. As is the case for all the following sliding box and roller bar positioning listings, a shorter or taller user may simply need to respectively lower or raise both positions by one level. This will adjust for height variations yet maintain the same weight support member angle for every user. A plurality of weight plate members are positioned such that approximately 50 to 100% of the total weight is located on the back part of the weight support frame. With the weight support member so positioned and weighted, the user, facing in toward the machine and seated on an incline bench or standing, does a four repetition maximum of the military press routine, i.e., the user lifts the weight support member straight up while resisting external humeral (shoulder) rotation through preferentially increased contraction of the anterior deltoid.

Posterior Portion of the Deltoid Muscle

With the weight support member positioned and weighted as above, the average user, seated on an incline bench or standing, turns around and faces away from the machine, and does a four repetition maximum of the military press routine, i.e., the user lifts the weight support member straight up while resisting internal humeral rotation through preferentially increased contraction of the posterior deltoid.

Lateral Portion of the Deltoid Muscle

The average user leaves the roller bar support member on the upwardly extending hook members in vertical position number 7 and locks the sliding box adjustment device in vertical position number 8 on the vertical adjustment post. These positions may be varied to suit the needs of the particular user. The weight plate members are positioned such that approximately 50 to 100% of the total weight is located on the front part of the weight support frame. The vertical position changes and shift in plate member loading to the front of the support frame reduce the effects of support frame angle changes through the exercise motion. This more closely simulates a free weight military press since the rotational torques around the handles are reduced. But more specifically these positions increase relative contraction of the lateral deltoid. The effect of plate loading shift is utilized for other exercises as well. The user, seated vertically on an incline or flat bench or standing, and facing in toward the machine, does a four repetition maximum of the military press routine, i.e., the user lifts the weight support member straight up.

EXAMPLE 2

[Involving a Muscle Segmented in the Longitudinal (Sagittal) Plane]

The following steps allow the user to selectively exercise the total biceps brachii muscle, or the distal or proximal portions thereof, respectively.

Total Biceps Brachii Muscle

To do this exercise in the seated position, the average user locks the sliding box adjustment device in vertical position number 5 on the vertical adjustment post and places the roller bar support member on the upwardly extending hook members in vertical position number 3. To do this exercise in the standing position, the average user locks the sliding box adjustment device in vertical position 7 and places the roller bar support member in vertical position number 5. These positions may be varied to suit the needs of the particular user. The weight plate members are positioned such that approximately 50 to 100% of the total weight is located on the front part of the weight support frame. The user, seated on an incline bench or standing, and facing in toward the machine, does a four repetition maximum of the arm curl, i.e., the user lifts the weight support member up and, flexing at the elbows, in toward the user's shoulders, encountering equivalent resistance throughout the range of motion.

Distal Portion of the Biceps Brachii Muscle

To do this exercise in the seated position, the average user locks the sliding box adjustment device in vertical position number 8 on the vertical adjustment post and places the roller bar support member on the upwardly extending hook members in vertical position number 4. To do this exercise in the standing position, the average user locks the sliding box adjustment device in vertical position number 9 and places the roller bar support member in vertical position number 5. These positions may be varied to suit the needs of the particular user. The weight plate members are positioned such that approximately 50 to 100% of the total weight is located on the back part of the weight support member. The user, seated on an incline bench or standing, and facing in toward the machine, does a four repetition maximum of the arm curl routine, i.e., the user lifts the weight support member up and, flexing at the elbows, in toward the user's shoulders, encountering maximum resistance in the early segment of elbow flexion and minimal resistance in terminal elbow flexion, thus selectively training the distal biceps brachii.

Proximal Portion of the Biceps Brachii Muscle

The average user locks the sliding box adjustment device in vertical position number 2 on the vertical adjustment post and places the roller bar support member on the upwardly extending hook members in vertical position number 2. These positions may be varied to suit the needs of the particular user. The weight plate members are positioned such that approximately 50 to 100% of the total weight is located on the back part of the weight support member. With the weight support member so positioned and weighted, the user, seated vertically on an incline bench and facing toward the machine, does a four repetition maximum of the arm curl routine, i.e., the user lifts the weight support frame straight up and, flexing at the elbows, in toward the user's shoulders, encountering maximum resistance late in the terminal segment of elbow flexion and minimal resistance in early elbow flexion, thus selectively training the proximal biceps brachii. The exercise could be done in the same manner but standing using sliding box and roller bar position 4.

EXAMPLE 3

[Involving a Muscle Partitioned in the Lateral (Frontal) Plane]

The following steps allow the user to selectively exercise the total pectoralis major muscle, or the clavicular (outer, upper) or sternal (inner, lower) portions thereof, respectively.

Total Pectoralis Major Muscle

The average user locks the sliding box adjustment device in vertical position number 5 on the vertical adjustment post and places the roller bar support member on the upwardly extending hook members in vertical position number 4. These positions may be varied to suit the needs of the particular user. The weight plate members are positioned such that approximately 50 to 100% of the total weight is located on the front part of the weight support frame. With the weight support member so positioned and weighted, the user lying head in on his/her back on a flat bench, does a four repetition maximum of the bench press routine, i.e., the user presses the weight support member straight up.

Clavicular Portion of the Pectoralis Major Muscle

The average user locks the sliding box adjustment device in vertical position number 10 on the vertical adjustment post and places the roller bar support member on the upwardly extending hook members in vertical position number 6. These positions may be varied to suit the needs of the particular user. The weight plate members are positioned such that approximately 50 to 100% of the total weight is located on the back part of the weight support frame. With the weight support member so positioned and weighted, the user, lying on a flat bench and facing up with the head in toward the machine, does a four repetition maximum of the bench press routine, i.e., the user presses the weight support member straight up, maximizing contraction of the clavicular segment to counteract or antagonize the glenohumeral (shoulder) extension force vector imposed by the weight support frame's angle toward the user.

Sternal Portion of the Pectoralis Major Muscle

The average user locks the sliding box adjustment device in vertical position number 10 on the vertical adjustment post and places the roller bar support member on the upwardly extending hook members in vertical position number 6. These positions may be varied to suit the needs of the particular user. The weight plate members are positioned such that approximately 50 to 100% of the total weight is located on the back part of the weight support frame. With the weight support member so positioned and weighted, the user, lying on a flat bench and facing up with the head away from the machine, does a four repetition maximum of the bench press routine, i.e., the user presses the weight support member straight up, recruiting the lower sternal portion of the pectoralis major to be the predominate force generator since it also resists the shoulder flexion vector produced by the weight support frame's angle toward the user.

EXAMPLE 4

[Involving a Lower Extremity Muscle Group]

The following steps allow the user to exercise the total gastrocnemius and soleus. The average user locks the sliding box adjustment device in vertical position number 9 and places the roller bar support member on the upwardly extending hook members in vertical position number 5. These positions may be varied to suit the individual user. The weight plate members are positioned such that approximately 50% of the total weight is located on the front part of the weight support frame. With the weight support frame so positioned and weighted, the user, lying on an incline bench and facing up and in toward the machine with knees slightly bent and feet positioned upon the foot plates of the weight support frame, pushes out with the toes to straighten the legs and then returns to the original position. This exercise routine is performed with the weight support member rolling over the roller bar support member. The roller bar is important and is used in about half the exercises. The gastrocnemius and soleus exercises can also be partitioned. The soleus can be isolated by keeping the knees bent to near 90 degrees during the full toe press (plantar flexion) movements. This shortens the gastrocnemius resulting in a mechanical disadvantage for tension generation. The medial and lateral portions of the gastroseleus complex could be selectively recruited by toe-out or toe-in positioning of the feet and by performing medial or lateral heel whips respectively during the toe press while keeping the knees extended.

The advantages of the present invention are numerous. First, the single-station exercise and rehabilitation weight-lifting machine of the present invention allows the user to perform substantially all of the natural movements of free weight lifting exercise routines. Second, the machine and method of the present invention allow the user to selectively recruit, isolate, and maximally contract a specific segment of a target muscle or task-specific synergistic segments of different muscles, allowing occupational or sport-specific task training. In addition, therapists as well as body builders could have the luxury of hypertrophy training within the same muscle group on a daily basis. Third, the machine allows the user to vary the portion of the range of motion in which he or she encounters the most resistance. Fourth, the machine is safe and easy for an individual user to operate. Fifth, the exercise and rehabilitation machine and method provide an optional or inherent vibrational component of force which stimulates muscle spindles to accentuate contraction, especially when nearing muscle fatigue. Sixth, the user can exercise a known prime mover muscle segment for a given motion without performing the actual motion, which may not be able to be completed secondary to a painful arc or musculoskeletal block of that motion. This could prevent disuse atrophy. Seventh, the weight support member of the machine can be positioned to actually assist muscles which have increased tone or spasticity or poor strength against gravity to achieve increased range of motion and functional strength, again furthering the machine's rehabilitation utility. Eighth, the second and third embodiment of the weight support member enable the user to exercise against all three main types of resistance: isotonic, isometric, and isokinetic. Ninth, the machine offers significant biomechanical features and advantages. Since the axis bar 16 slides through a pivoting axis tube 60 exercisers of all dimensions can use the machine with equal effectiveness since the length of the resistance arm and arc of range of motion will passively accommodate to different limb lengths and heights of the user. Also, since the front forks of the side runners 18 and their weight support posts 30*a–d* are located forward of the handles weight loading on the front of the weight support member versus the back provides the user/therapist the option of working against either a third class or a second class lever system, presenting another unique method of varying resistances on the machine. Tenth, the built-in and adjustable safety features and range of motion blocks help prevent injuries and allow a single user to have a safe comprehensive workout without a spotter.

Finally, the user may exercise specific segments of the same muscle group at different times so part of the group can be exercised more frequently than the normal 48 to 72 hour period and thus increase the potential number and frequency of therapy sessions with speeding up of the rehabilitation and strengthening processes as previously described.

A very important aspect of the present invention is related to eccentric (lengthening) contractions which can produce more force than concentric (shortening) contractions of the same muscle. Some authorities feel that strength training must be done slowly and forcefully and should optimally involve more resistance added to the eccentric phase to maximize hypertrophy gains by maximizing the force generated by a muscle in both the concentric and eccentric phases.

The present invention's resistance increases as the weight support member is moved out away from the posterior vertical adjustment standard (longer resistance arm) on the front side of the axis tube (fulcrum). This requires the lifter to support more sled weight. This can easily be taken advantage of to increase the eccentric resistance during a given motion by performing the concentric phase close to the front standards (shorter resistance arm), then guiding the weight support member further from the front standards (longer resistance arm) perform the eccentric phase of the motion. This will increase the eccentric load relative to the concentric load without having someone else manually add more weight plates or resistance to the eccentric phase. This allows maximum concentric and eccentric force generation in the same repetition.

This has never before been possible to do alone with any free weights or weight plate loading apparatus, and represents a significant advantage.

Many variations will be apparent to those skilled in the art. It is therefore to be understood, that within the scope of the appended claims, the invention may be practiced other than as specifically described.

APPENDIX

BASIC EXERCISE POSITION CHART

| Exercise | Muscle | Segment and Synergists | Roller Bar Level | Sliding Box Level | Notes[1,2,3,4,5,*] |
|---|---|---|---|---|---|
| Upright Row | Trapezius (upper back) | posterior midline | 5 | 9 | face out, shrug shoulders up, bend arms, and bring weight support member handlebar up under chin |
| | | anterior/lateral | 5 | 9 | face in and repeat movement above |
| | | total | 5 | 7 | face in and repeat movements above |
| Military Press | Deltoid (shoulder) | posterior | 7 (8) | 11 (12) | face out and press weight support member handles overhead from a seated position on a flat bench |
| | | anterior | 7 (8) | 11 (12) | face in and repeat movements above |
| | | lateral | 7 | 9 (8) | face in and repeat movements above |
| Lat Pulls* | Latissimus Dorsum (back) | upper lateral | 4 | 2 | face in and down on an incline bench, and with palms down pull handles down behind the head. |
| | | lower midline | 4 | 2 | face in and down on an incline bench, and with palms up (close grip), pull handles in |
| | | total | 4 | 2 | face in and up on back on an incline bench, and with palms up pull handles down |
| Bench Press | Pectoralis (chest) | lower midline (sternal) | 6 | 10 | head out on back on flat bench, and press handlebar up with a close grip |
| | | upper lateral (clavicular) | 6 | 10 | head in on back on flat bench, and with a wider grip, press handles up |
| | | total | 4 | 5 | head in on back on a flat bench, and press handles up with a regular width grip |
| Arm Curl | Bicep | lower (distal) | 5 | 9 | face in and curl handles or handlebar up flexing at the elbows and return |
| | | total | 5 | 7 | same movements as above |
| | | upper (proximal) | 4 | 4 | same movements as above |
| Tricep Press Over | Tricep | upper (long head) | 4 | 7 | lying on a flat bench with head in, face up, and elbows in above head, press handlebar up directly over head |
| | | total | 3 | 5 | same movements as above |
| | | lower (short head) | 3 | 3 | same movements as above |
| Wrist Curls/ Extensions | Forearm | distal flexors | 3 | 5 | sitting on end of bench with face in and palms up, curl handlebar up and down at the wrist |
| | | proximal flexors | 2 | 2 | same movements as above |
| | | distal extensors | 3 | 5 | sitting on end of bench with face in and palms down, curl handlebar up and down at the wrist |
| | | proximal extensors | 2 | 2 | same movements as above |
| Crunches/ Leg Lifts* | Abdomen | upper abs | 6 | 8 | lying on back on a flat bench with head out, grasp handlebar at chest and curl trunk upwards towards machine |
| | | lower abs (iliopecas) | 3 | 2 | sitting on an incline or flat bench, face in and pull handlebar with feet, bringing knees to chest |
| Back Extensions* | Low Back Hip Extensors | total | 4 | 2 | sitting on a flat bench, face in and pull handlebar with straight arms extending back |
| | | lower erectors | 3 | 7 | standing, face in and pull handle up with straight |

APPENDIX-continued

BASIC EXERCISE POSITION CHART

| Exercise | Muscle | Segment and Synergists | Roller Bar Level | Sliding Box Level | Notes[1,2,3,4,5,*] |
|---|---|---|---|---|---|
| | | | | | arms by extending back |
| | | hip extensors (gluteus?) | 1 | 1 | same movements as above |
| Squat/ Leg Press* | Quadricep (thigh) | proximal quads (gluteus maximus) | 7 | 11 | face in with handlebars across back of shoulders, and squat up and down |
| | | distal quads | 5 | 4 | same movements as above |
| | | total quads | 5 | 9 | face in on an incline bench and press on cross bar foot plates extending leg |
| Lunge Squat | Hamstring | proximal hamstrings (eccentric focus) | 2 | 4 | face in, grasp handles, and slowly step forward into 1 leg lunge and return |
| Leg Curls* | Gluteus maximus | distal hamstrings | 1 | 1 | same movements as above |
| | | total hamstrings | 3 | 2 | with leg curl attachment, head out and face down, curl heals up towards buttocks and return |
| Calf Press* | Gastrocnemius (calf) and Soleus | lateral proximal | 7 | 4 | face in with feet slightly turned out and handlebar behind neck, raise up on toes as heels pivot outward |
| | | medial distal | 7 | 12 | face in with feet slightly turned in and handlebar behind neck, raise up on toes as heels pivot inward |
| | | total | 5 | 9 | face in on an incline bench with knees bent slightly, push out with toes and return |

[1]Unless noted otherwise, use a standing position.
[2]Use slow motion for maximum size and strength.
[3]Shorter users may need to lower the sliding box adjustment device and roller bar support member each by one vertical level, whereas taller users may need to raise each by one vertical level.
[4]The user should perform 2 to 3 sets of the 4 repetition maximum weight per exercise for efficient stregth/hypertrophy gains.
*These exercises are intended to be done with the weight support member rolling over the roller bar support member.
[5]Only the concentric phase is described for most exercises above, slowly reverse the motion on the eccentric phase to return to the starting position

What is claimed as new and desired to be secured by Letters Patent of the United States is:

1. An exercise and rehabilitation weight-lifting machine, comprising:

a support frame including a pair of anterior upright support members and a posterior upright support member;

a weight support member with an anterior end and a posterior end with an elongated extension at said posterior end with an elongated extension at said posterior end;

a front weight placement member on said anterior end of said weight support member for the placement of weights to provide a downward force component at said anterior end;

a front support member extending across said pair of anterior upright support members;

a vertically adjustable pivot device on said posterior upright support member;

user force applicators on said weight support member for moving said weight support member against said downward force component;

said weight support member being pivotally supported at said posterior end by said pivot device for vertical, horizontal, longitudinal linear and longitudinally axial rotational movements; and said weight support member supported at said anterior end by said front support member with said weight support member having a downward force component anterior of said user force applicators when weights are placed on said front placement member.

2. An exercise and rehabilitation weight-lifting machine as recited in claim 1, wherein said front support member is a vertically adjustable roller bar.

3. An exercise and rehabilitation weight-lifting machine as recited in claim 1, wherein a vibrating device is attached to said weight support member to impart vibrational motion to the user.

4. An exercise and rehabilitation weight-lifting machine as recited in claim 1, wherein said weight support member further comprises:

a weight support frame; and said elongated extension is a support axis bar attached to said weight support frame.

5. An exercise and rehabilitation weight-lifting machine as recited in claim 4, wherein said pivot device is in the form of a sliding box.

6. An exercise and rehabilitation weight-lifting machine as recited in claim 5, wherein said sliding box comprises:

an open box having four walls;

two rolling pins which extend through two of said walls;

two bushings which are attached to the interior of said box;

oval openings in two of said walls;

a pivot pin extending through said oval openings;

a pull pin which extends through at least one wall of said box; and an axis tube pivotally attached to said box by said pivot pin.

7. An exercise and rehabilitation weight-lifting machine as recited in claim 1, wherein said weight support member comprises:

a weight support frame; and said elongated extension is a telescoping hydraulic cylinder attached to said weight support frame.

8. An exercise and rehabilitation weight-lifting machine as recited in claim 7 wherein:

said weight support frame has front ends, rear ends and two parallel runners;

a front cross bar spanning the space between said runners;

a back cross bar parallel to said front cross bar spanning the space between said runners;

two spaced apart tubular tunnels affixed to and extending between said front cross bar and said back cross bar through which said runners slide;

a cross bridge connecting said rear ends of said runner; and a hydraulic cylinder assembly having two ends which are affixed to said cross bridge and said front cross bar.

9. An exercise and rehabilitation weight-lifting machine as recited in claim 8 wherein said weight support frame includes;

at least one moveable stop having an actuated and a non-actuated position on said cross member to arrest any forward movement of said weight support frame when said stop is moved to said actuated position;

said user force applicators being handles located at said front ends of said runners behind said front weight placement member;

rear weight placement members located on said cross member;

a plurality of vertically spaced apart hook members located on each of said pair of anterior upright support members; and a fixed lock bar extending from each of said front ends of said runners adapted to be placed on said hook members.

10. A weight-lifting machine comprising:

a support frame including a pair of anterior vertical support members and a posterior vertical support member;

a weight support member with an anterior end in the form of a weight support frame and a posterior end in the form of an elongated extension bar attached to said weight support frame;

a front support member in the form of a vertically adjustable roller bar for supporting said weight support frame;

a vertically adjustable pivot device riding on said posterior vertical support member carrying said elongated extension bar in a pivotal support for vertical, longitudinal linear and longitudinally axial rotational movements of said weight support frame relative to said pivot device;

said weight support frame including;

two parallel and horizontally spaced apart runners having front ends and rear ends;

a cross member connecting the rear ends of said runners;

at least one moveable stop having an actuated and a non-actuated position on said cross member to arrest any forward movement of said weight support frame when said stop is moved to said actuated position;

a pair of handles for application of force by the user located at said front ends of said runners;

front weight support members located at said front ends of said runners forward of said handles; and rear weight support member located on said cross member;

a plurality of vertically spaced apart hook members located on each of said pair of anterior vertical support members; and a fixed lock bar extending sideways for each of said front ends of said runners adapted to be placed on said hook members.

11. A weight-lifting machine as recited in claim 10 which includes a vibration device attached thereto to cause said handles to vibrate to impart vibrational motion to the user during exercise.

12. A weight-lifting machine as set forth in claim 10, wherein foot plates are attached to said cross member for performing leg exercises.

13. A weight-lifting machine as set forth in claim 10 wherein back bar stops are attached to and project outward from said weight support frame at a location adjacent said rear ends of said runners for limiting the movement of said weight support frame.

14. A weight-lifting machine as set forth in claim 13 wherein said at least one moveable stop is located intermediate said rear ends and said front ends of said runners for limiting the movement of said weight support frame.

* * * * *